US007073690B2

(12) United States Patent
Marelli

(10) Patent No.: US 7,073,690 B2
(45) Date of Patent: Jul. 11, 2006

(54) INVERTIBLE PUMP WITH AIR PASSAGEWAYS, FOR DISPENSING ATOMIZED LIQUIDS

(75) Inventor: Andrea Marelli, Rozzano (IT)

(73) Assignee: Microspray Delta S.p.A., Fizzonasco di Pieve Emanuele (IT)

( * ) Notice: Subject to any disclaimer, the term of this patent is extended or adjusted under 35 U.S.C. 154(b) by 189 days.

(21) Appl. No.: 10/917,325

(22) Filed: Aug. 13, 2004

(65) Prior Publication Data

US 2005/0098585 A1 May 12, 2005

(30) Foreign Application Priority Data

Nov. 10, 2003 (IT) ..... MI2003A2162

(51) Int. Cl.
*B65D 5/40* (2006.01)

(52) U.S. Cl. ..... 222/321.4; 222/321.9

(58) Field of Classification Search ..... 222/321.4, 222/321.9, 376

See application file for complete search history.

(56) References Cited

U.S. PATENT DOCUMENTS

| | | | | |
|---|---|---|---|---|
| 4,277,001 | A | 7/1981 | Nozawa | |
| 4,775,079 | A | 10/1988 | Grothoff | |
| 5,222,636 | A | 6/1993 | Meuresch | |
| 5,353,969 | A | 10/1994 | Balderrama | |
| 5,738,252 | A | 4/1998 | Dodd et al. | |
| 6,942,125 | B1 * | 9/2005 | Marelli | 222/321.4 |

FOREIGN PATENT DOCUMENTS

| | | |
|---|---|---|
| EP | 0 648 545 A1 | 4/1995 |
| EP | 1 029 597 A1 | 8/2000 |

* cited by examiner

*Primary Examiner*—Philippe Derakshani
(74) *Attorney, Agent, or Firm*—Oblon, Spivak, McClelland, Maier & Neustadt, P.C.

(57) ABSTRACT

Manually operable pump for dispensing atomized liquids, the pump having passageways enabling air to enter the container on which the pump is mounted, when a vacuum forms in the container on dispensing liquid through the pump.

2 Claims, 2 Drawing Sheets

INVERTIBLE PUMP WITH AIR PASSAGEWAYS, FOR DISPENSING ATOMIZED LIQUIDS

FIELD OF THE INVENTION

The present invention relates to a manually operated invertible pump for dispensing atomized liquids withdrawn from a liquid container, on the mouth of which the pump is mounted usable both in the upright position, i.e. with the pump facing upwards from the container, and in the inverted position, i.e. with the pump facing downwards from the container.

BACKGROUND OF THE INVENTION

Many types of invertible pumps are known, such as those described in U.S. Pat. No. 5,222,636, U.S. Pat. No. 4,775,079, U.S. Pat. No. 4,277,001, U.S. Pat. No. 5,353,969, U.S. Pat. No. 5,738,252, EP-A-0648545 and EP-A-1029597.

All pumps, whether invertible or non-invertible (i.e. usable with the pump only in the upright position) must enable air to escape from the compression chamber of each pump on priming (i.e. when the air present in the pump compression chamber must be expelled to the outside, to enable a vacuum to form in the chamber, with consequent drawing of liquid into the pump), and to enable external air to enter the container on which the pump is mounted when a vacuum forms in the container following liquid dispensing by the pump.

The problem of external air entry into the container is particularly delicate in the case of invertible pumps, because such pumps must be able to be used and operated without liquid leakage or escape when the pump is in the inverted position, i.e. surrounded by and immersed in liquid which collects in proximity to the container mouth when the pump is mounted; this means that air must be able to enter the container through passageways from which, however, the liquid must not flow or drip out.

The most effective system is that described in U.S. Pat. No. 5,353,969 in which between the outer surface of the end of the pump hollow body and the opposing inner surface of the ring cap which fixes the pump to the container mouth there is provided a long, thin spiral groove, of which one end is open to the pump exterior and the other end opens below the pump, i.e. in communication with the interior of the container on which the pump is mounted: the dimensioning of the spiral groove is critical, being such as to prevent liquid outflow through it (with consequent dripping from the pump when used in the inverted position) but to allow passage of the air drawn from the outside into the container when a vacuum is formed therein following liquid dispensing by the pump. However, this system presents numerous drawbacks, such as the considerable difficulty of moulding the various components of the pump, the structure of which is very complex, the possible outward dripping of liquid through the grooves when the pump is in its inverted position and is retained in that position without the pump being operated, and the possible escape through the grooves of vapour originating from the liquid enclosed in the container when the pump is in its upright position.

SUMMARY OF THE INVENTION

The main object of the present invention is to provide an invertible pump with air passageways for the aforesaid purpose, in which the pump and its new components are of simple structure, very easy and economical to produce, and simple to assemble, and in which any dripping of liquid to the pump exterior is totally prevented even when maintained for lengthy periods in the inverted position, either with the pushbutton completely pressed down or left free in its rest position.

This and further objects are attained by a pump comprising a cup-shaped body housing a sealedly translatable piston to which one end of a hollow stem is connected, its other end projecting from the cup-shaped body and carrying a cap for manually operating the pump and for dispensing the atomized liquid, a ring cap for applying the cup-shaped body and with it the pump to the mouth of a container for the liquid to be dispensed and a seal gasket interposed between the ring cap, the cup-shaped body and the hollow stem, wherein the outer surface of the hollow stem is of reduced diameter at that portion thereof which lies opposite the gasket when the stem is in an intermediate position between its two end-of-travel positions, to leave free an air passageway between the stem and the gasket, there being provided between the gasket and the cup-shaped body and respectively between the cup-shaped body and said ring cap at least one narrow passageway which connects that portion of the cavity of the cup-shaped body situated between the pump piston and the gasket to the free space between the outer surface of the cup-shaped body and the ring cap.

Preferably, said passageway between the cup-shaped body and the ring cap is defined by at least one discontinuous rib which projects from the outer surface of the cup-shaped body to abut against the opposing surface of the ring cap.

BRIEF DESCRIPTION OF THE DRAWINGS

The ensuing description illustrates a non-limiting embodiment of the pump, given with reference to the accompanying drawings, in which.

DETAILED DESCRIPTION OF THE INVENTION

Figure 1:
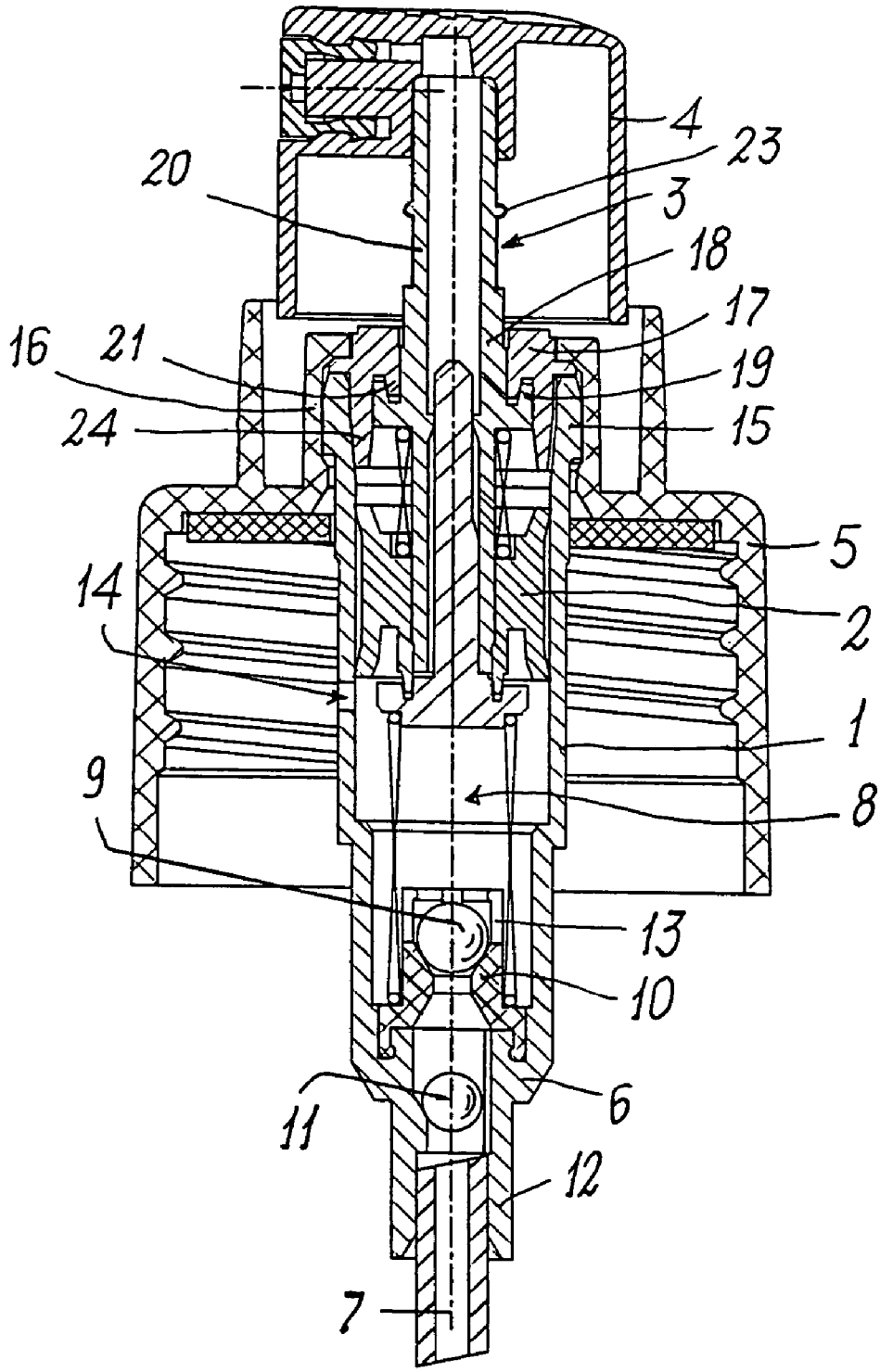
FIG. 1 is a longitudinal section through a pump shown in its rest position.

The pump shown in FIG. 1 has a structure totally similar to that illustrated in EP-A-1334774 and comprises a cup-shaped body 1 housing a piston 2 sealedly translatable within the cylindrical cavity of the body 1, a hollow stem 3, of which the lower end (with respect to FIG. 1) is connected to the piston 2 and the upper end carries, projecting above the body 1, a cap 4 for manually operating the pump and for dispensing the atomized liquid.

The pump body 1 can be screwed onto the mouth of a container (not shown) by a threaded ring cap 5, also of known structure.

The lower end of the body 1 is bounded by a base wall 6 having a hole in which one end of a dip tube 7 is mounted to enable the liquid to rise from the container to a suction and compression chamber 8, intercepted lowerly by a ball 9 housed and movable within a cage 10 below which a ball 11 is housed translatable within the cylindrical hole of an appendix 12 presenting longitudinal grooves (which prevent the ball 11 from forming a seal within the hole of the appendix 12). The ball 9 is translatably retained within the cage 10 by a series of tubular appendices 13 which project from the cage and have their free ends bent towards the pump axis: the balls 9 and 11 form, with the respective seal seats provided in the cage 10, two unidirectional valves which enable communication between the chamber 8 and the cavity of the dip tube 7, or which intercept and prevent this communication, when the pump is in the upright position (as shown in the drawings) or is in the inverted position respectively: in this latter case the liquid can penetrate into the cavity 8 through an aperture 14 provided in the body 1 (position in which the ball 11 rests and seals against its seat in the cage 10).

Figure 2:
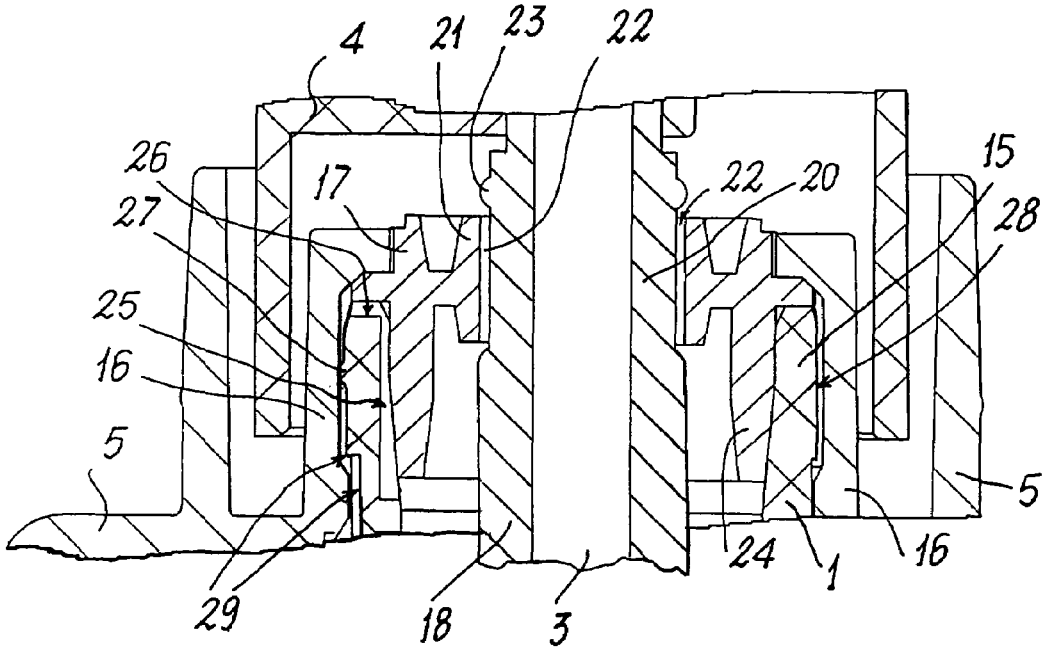
FIG. 2 is an enlarged section through that pump portion about its inner seal gasket, shown in that position in which the pump stem lies between its two end-of-travel positions.

The pump structure described up to this point does not form part of the present invention, which instead relates to the structure of the upper part (with respect to FIG. 1) of the pump, where it can be seen that the free end 15 of the body 1 is inserted into and retained in a seat defined by a tubular wall 16 of the ring cap 5 with an interposed seal gasket 17 which is in contact with the inner surface of the end 15 of the body 1 and seals against the outer surface of the portion 18 of the stem 3 when the stem 3 (and hence the pump) is in its rest position shown in FIG. 1 (in which an annular rim 19 projecting from the stem is inserted into and seals within an annular seat provided on the adjacent surface of the gasket 18). As can be seen from the drawings, the outer surface of the stem 3 is not of constant diameter, but presents a portion 20 of smaller diameter than the portion 18: this stem portion 20 is provided in such a position and has such dimensions that when the pump is operated and the stem is in an intermediate position (FIG. 2) between its two end-of-travel positions, a passageway 22 through which air can penetrate from the outside to the inside of the pump chamber 8 is left free between the surface of said reduced portion 20 of the stem and the opposing surface of a lip 21 forming part of the gasket 17.

Figure 3:
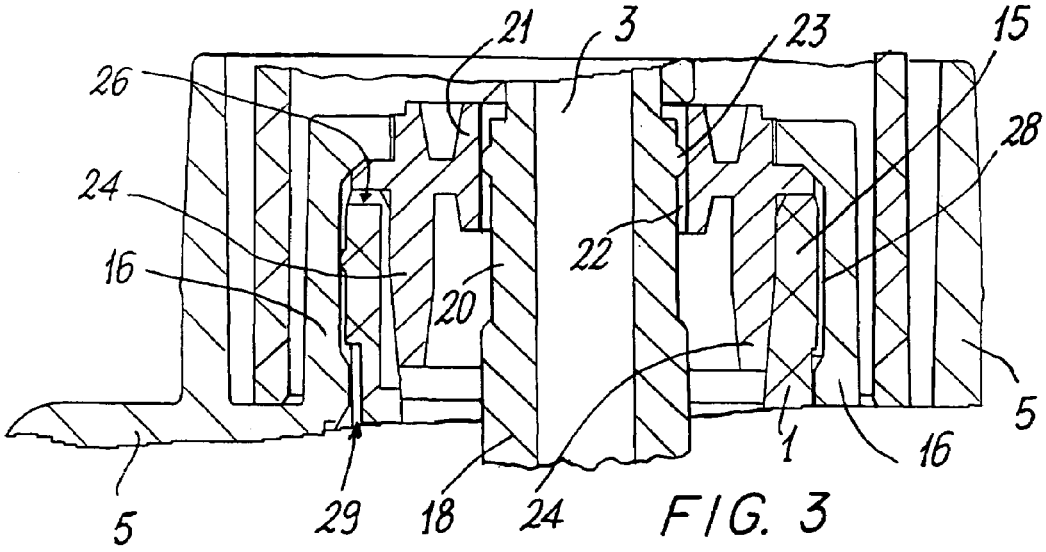
FIG. 3 is similar to FIG. 2 but with the pump stem pushed totally down into its end-of-travel position to operate the pump.

From the drawings it can be seen that a continuous annular rib 23 projects from the reduced portion 20 of the stem 3, to position itself and seal against the lip 21 of the gasket when the stem is pushed completely down (FIG. 3) to its end-of-travel position within the pump body 1.

From the drawings (in particular the left portion of the enlarged view of FIG. 2) it can also be seen that the seal gasket 17 has a tubular annular appendix 24 which is inserted into the end 15 of the body 1, but leaving free a narrow passageway 25 which prolongs into a passageway 26 provided between the gasket and the free end of said end 15 of the body 1, this end 15 presenting on its outer surface an annular rib 27 which is discontinuous (i.e. interrupted along a short length): at the interruption in the annular rib 27, between the outer surface of the end 15 and the opposing inner surface of the tubular wall 16 of the ring cap 5 (where the free end of the body 1 is inserted and securely retained) a narrow passageway 28 is formed opening below the rib 27 in a free annular space 29 which is in free communication with the outside of the pump body.

It will be assumed that the pump is in the rest state of FIG. 1 in which the lip 21 of the gasket 17 seals against the portion 18 of the stem 3, the seal being considerably increased by the forced insertion of the annular rim 19 of the stem into the annular seat provided on the lower face of the gasket. Under these conditions the interior of the pump body and the interior of the container on which the pump is sealedly mounted are completely isolated from the outside environment independently of whether the pump is in its upright or inverted position.

When the pump is operated, the stem 3 is lowered into the pump body and its reduced portion 20 becomes positioned in front of the gasket lip 21 (FIG. 2), leaving free the passageway 22 through which air can pass (from the outside to the inside) to directly penetrate into the container through the passageways 22, 25, 26, 28. This air passage from the outside to the inside of the container can take place only if the container is under vacuum, which occurs each time liquid is dispensed to the outside by the pump.

It will be noted that, even if the pump is used in the inverted position, the liquid in which the pump is immersed cannot escape through said small passageways both because the air drawn in by said vacuum flows through them (from the outside to the inside), and because these passageways are of very small cross-section and define a very tortuous path. With further lowering of the stem 3 within the body 1 (i.e. when the pump is pushed down to its end-of-travel position to dispense all the liquid collected within the pump cavity), the continuous annular rib 23 projecting from the stem becomes positioned against the lip 21 of the gasket 17 (FIG. 3), so sealing against it and preventing escape or dripping of the liquid, even if the pump is used in the inverted position.

It can be added that the described pump structure is very simple, with all its components being very simple to produce and install, so that the cost of the finished pump fixed onto the ring cap 5 is also very low.

The invention claimed is:

1. An invertible pump for dispensing an atomized liquid, having air passageways and comprising a cup-shaped body housing a sealedly translatable piston to which one end of a hollow stem is connected, its other end projecting from the cup-shaped body and carrying a cap for manually operating the pump and for dispensing the atomized liquid, a ring cap for applying the cup-shaped body and with it the pump to the mouth of a container for the liquid to be dispensed and a seal gasket interposed between the ring cap, the cup-shaped body and the hollow stem, wherein the outer surface of the hollow stem is of reduced diameter at that portion thereof which lies opposite the gasket when the stem is in an intermediate position between its two end-of-travel positions, to leave free an air passageway between the stem and the gasket, there being provided between the gasket and the cup-shaped body and respectively between the cup-shaped body and said ring cap at least one narrow passageway which connects that portion of the cavity of the cup-shaped body situated between the pump piston and the gasket to the free space between the outer surface of the cup-shaped body and the ring cap.

2. An invertible pump as claimed in claim 1, wherein said passageway between the cup-shaped body and the ring cap is defined by at least one discontinuous rib which projects from the outer surface of the cup-shaped body to abut against the opposing surface of the ring cap.

* * * * *